US011760537B1

(12) United States Patent
Cosentino

(10) Patent No.: US 11,760,537 B1
(45) Date of Patent: Sep. 19, 2023

(54) NESTABLE STEEL PALLET

(71) Applicant: Silvaclear Inc., Caledon (CA)

(72) Inventor: Chris Cosentino, Caledon (CA)

( * ) Notice: Subject to any disclaimer, the term of this patent is extended or adjusted under 35 U.S.C. 154(b) by 63 days.

(21) Appl. No.: 17/869,371

(22) Filed: Jul. 20, 2022

(51) Int. Cl.
*B65D 19/38* (2006.01)
*B65D 19/08* (2006.01)

(52) U.S. Cl.
CPC ..... *B65D 19/38* (2013.01); *B65D 19/08* (2013.01); *B65D 2519/00024* (2013.01); *B65D 2519/00059* (2013.01); *B65D 2519/0081* (2013.01); *B65D 2519/0095* (2013.01); *B65D 2519/00164* (2013.01); *B65D 2519/00268* (2013.01); *B65D 2519/00288* (2013.01); *B65D 2519/00318* (2013.01); *B65D 2519/00338* (2013.01); *B65D 2519/00497* (2013.01); *B65D 2519/00641* (2013.01)

(58) Field of Classification Search
CPC ..... B65D 19/08; B65D 19/38; B65D 2519/00024
USPC ..... 206/600, 503, 505, 507, 511, 514
See application file for complete search history.

(56) References Cited

U.S. PATENT DOCUMENTS 2,463,214 A * 3/1949 Stoner ..... B65D 19/0038 108/57.1
4,000,704 A * 1/1977 Griffin, Jr. ..... B65D 71/0096 108/55.3
5,564,599 A * 10/1996 Barber ..... B65D 11/1853 222/105
6,289,823 B1 9/2001 Koefelda et al.
8,146,771 B1 * 4/2012 Segeleon ..... B65D 19/18 206/499
10,604,297 B2 3/2020 Lim
2015/0108037 A1 * 4/2015 Evans ..... B65D 19/18 108/50.11

FOREIGN PATENT DOCUMENTS

WO WO-2015067980 A1 * 5/2015 ..... B65D 19/0048
WO WO-2019202500 A1 * 10/2019 ..... B65D 19/0018

* cited by examiner

*Primary Examiner* — Rafael A Ortiz
(74) *Attorney, Agent, or Firm* — SANCHELIMA & ASSOCIATES, P.A.; Christian Sanchelima; Jesus Sanchelima

(57) ABSTRACT

A nestable steel pallet, including a pallet assembly, a support assembly, and a nesting assembly. The pallet assembly includes a layer. The layer includes stiffening ribs enclosed in a pallet frame. The stiffening ribs are equidistantly separated defining slots. Cargo is fixed to said layer by tying straps in said stiffening ribs. The support assembly includes a load retainer to prevent cargo from shifting over the edges of said pallet. The load retainer extends upwardly from the edges of said layer. The nesting assembly includes stacking elements. The stacking elements extend downwards beneath said layer. The stacking elements are inserted in stacking elements of additional nestable steel pallets to nest a plurality of nestable steel pallets. The nestable steel pallet is formed through the metal stamping process.

1 Claim, 7 Drawing Sheets

NESTABLE STEEL PALLET

BACKGROUND OF THE INVENTION

1. Field of the Invention

The present invention relates to a nestable steel pallet and, more particularly, to a nestable steel pallet that allows support and place goods over it and be nested to store plurality of pallets, reducing storage space.

2. Description of the Related Art

Several designs for pallets have been designed in the past. None of them, however, include the use of the metal stamping process to form the pallet.

Applicant believes that a related reference corresponds to U.S. Pat. No. 10,604,297 issued for a modular pallet for use in supporting and transporting goods. Applicant believes that another related reference corresponds to U.S. Pat. No. 6,289,823 issued for a nestable pallet that includes a top deck which has a substantially planar surface upon which a plurality of objects is used to provide stiffness. None of these references, however, teach of a nestable steel pallet which uses the metal stamping process to form a low-thickness surface having a plurality of stiffening ribs and indentations which are used to nest additional pallets thereinto.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a nestable steel pallet that is made of thin gauge high strength steel which allows the pallet to have high strength and be stored nested with other nestable steel pallets in small spaces.

It is another object of this invention to provide a nestable steel pallet that includes stiffening ribs to provide structural support to the pallet.

It is another object of this invention to provide a nestable steel pallet that includes hook attachments to allow in attaching side panels or cargo thereto.

It is another object of this invention to provide a nestable steel pallet that includes stacking elements, the stacking elements allow to nest a plurality of pallets.

It is another object of this invention to provide a nestable steel pallet that is made having such thickness that allows having a pallet with a reduced weight when compared to pallets known in the prior art.

It is still another object of the present invention to provide a nestable steel pallet that includes a side wall cargo retainer that prevents cargo from shifting over the edges of the pallet.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
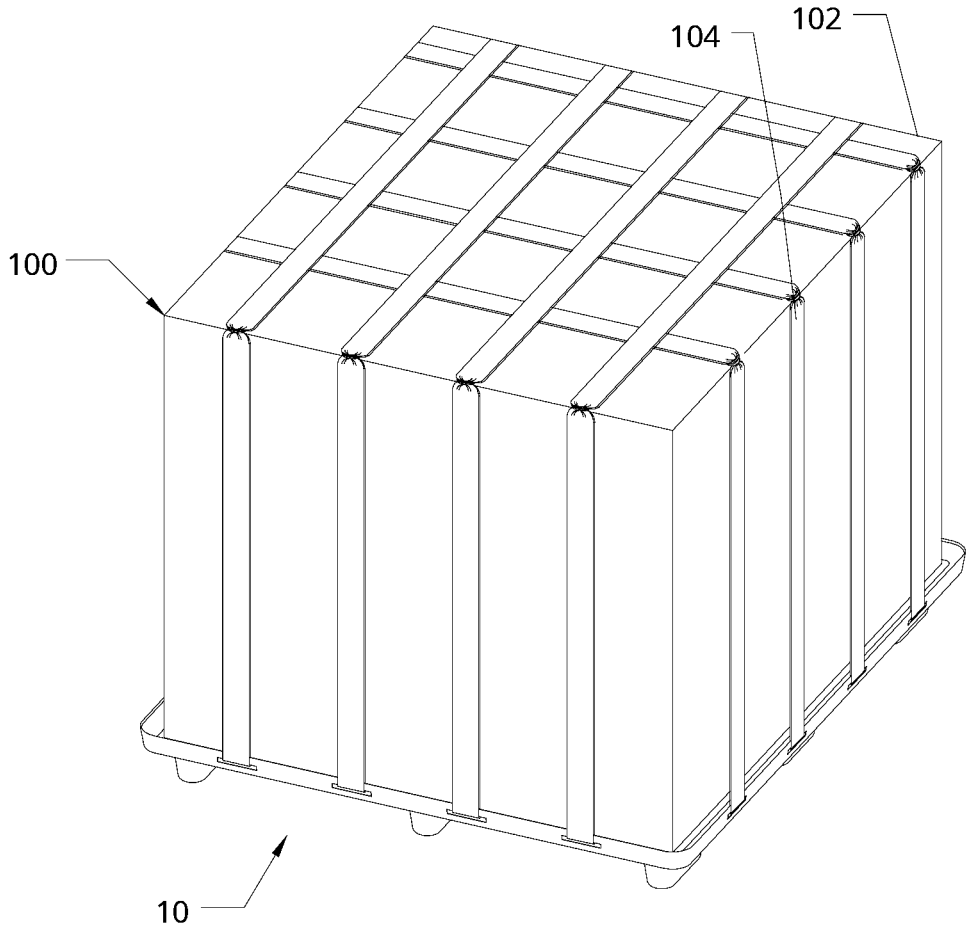
FIG. 1 represents an isometric operational view of the present invention 10 supporting cargo assembly 100, the cargo assembly includes cargo 102 and straps 104. The straps 104 are attached to the nestable steel pallet 10.

Referring now to the drawings, where the present invention is generally referred to with numeral 10, it can be observed that it basically includes a pallet assembly 20, a support assembly 40 and a nesting assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The pallet assembly 20 may include stiffening ribs 22 and slots 24. The stiffening ribs 22 may be arranged in a grid configuration. The stiffening ribs 22 may be vertical and horizontally attached. It should be understood that the stiffening ribs 22 may have a diagonal disposition, a curved disposition, a zig-zag disposition, or any other suitable disposition in layer 22 which defines slots 24 among the stiffening ribs 22. The stiffening ribs 22 may be made of ultra-high strength steel. It should be understood that it also may be suitable for the stiffening ribs 22 to be made of aluminum, copper, mild steel, or any other suitable material that can be modified through the metal stamping process. The metal stamping process is known in the prior art as being a cold-forming process that uses dies and stamping presses to transform sheets of metal into different shapes. The stiffening ribs 22 may have a shape defined through the metal stamping process. The stiffening ribs 22 may have a predetermined thickness. In a preferred embodiment the thickness of the stiffening ribs 22 is of 0.020 to 0.032 inches. It should be understood that the thickness of the stiffening ribs 22 may vary in accordance to predetermined applications or weight of predetermined loads. The stiffening ribs 22 may extend downwards defining a semi cylindrical shape. It also may be suitable for the stiffening ribs 22 to be defined having a rectangular shape, a triangular shape, or any other suitable shape. The stiffening ribs 22 may be attached having a predetermined separation. The predetermined separation between stiffening ribs 22 may define slots 24. The slots 24 may have a rectangular shape. It also may be suitable for the slots 24 to have a rhomboid shape, a triangular shape, a circular shape, or any other suitable shape. The sides of slots 24 may be defined for the stiffening ribs 22. As best illustrated in FIG. 1, cargo 102 may be secured to the present invention 10 through straps 104. Straps 104 may surround the sides of the cargo 102 and be attached underneath the present invention 10. It may be suitable for the straps 104 to be attached to the present invention by inserting the straps 104 into the slots 24 and fixing the straps 104 to the stiffening ribs 22.

The support assembly 40 may include a pallet frame 44, a load retainer 46 and at least two hook attachments 48. The pallet frame 44 may surround the grid configuration of stiffening ribs 22. The pallet frame 44 may be coplanar to the stiffening ribs 22. The pallet frame may be made of ultra-high strength steel. It should be understood that it also may be suitable for the pallet frame 44 to be made of aluminum, copper, mild steel, or any other suitable material that can be modified through the metal stamping process. The metal stamping process is known in the prior art as being a cold-forming process that uses dies and stamping presses to transform sheets of metal into different shapes. The pallet frame 44 may have a shape defined through the metal stamping process. The pallet frame 44 may have a predetermined thickness. In a preferred embodiment the thickness of the pallet frame 44 is of 0.020 to 0.032 inches. It should be understood that the thickness of the pallet frame 44 may vary in accordance to predetermined applications or weight of predetermined loads. The pallet frame 44 and the stiffening ribs 22 may be a monolithic element. The particular shapes of the pallet frame 44 and the stiffening ribs 22 may be defined through the stamping process using a single layer of material. It also may be suitable to weld the stiffening ribs 22 and the pallet frame together, or attaching them by any other means known in the prior art.

The load retainer 46 may be located on the edges of pallet frame 44. The load retainer 46 may have a rectangular-framed shape with curved corners in accordance with the shape of the pallet frame 44. The load retainer 46 may extend perpendicularly upwards from the edges of the pallet frame 44. The load retainer 46 may extend perpendicularly outwards from the pallet frame 44 with a predetermined inclination. In a preferred embodiment the predetermined inclination is four degrees. The load retainer 46 may be formed through the metal stamping process. The load retainer 46 may be made of ultra-high strength steel. It should be understood that it also may be suitable for load retainer 46 to be made of aluminum, copper, mild steel, or any other suitable material that can be modified through the metal stamping process. The load retainer 46 may be used for preventing cargo 102 from shifting over edges of the nestable steel pallet 10. The thickness of the load retainer 46 may vary in accordance with the weight of the cargo 102 placed over the nestable steel pallet 10 or according to the type of cargo 102 placed over the nestable steel pallet 10. The load retainer 46 may include at least two hook attachments 48.

The at least two hook attachments 48 may be located on each side of the load retainer 46. The at least two hook attachments 48 may be openings that transversally go through the sides of the load retainer 46. The at least two hook attachments 48 may have a rectangular shape. It also may be suitable for the at least two hook attachments 48 to have a circular shape, a triangular shape, or any other suitable shape. The at least two hook attachments 48 may be used to attach the side panels 82 to the support assembly 40. It also may be suitable to use the at least two hook attachments 48 to tie the straps 104 of cargo 102 to the present invention 10.

Figure 5:
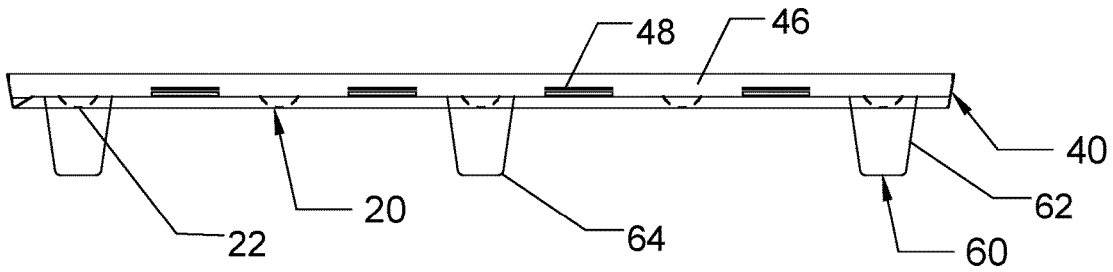
FIG. 5 depicts a front view of the present invention 10.
Figure 6:
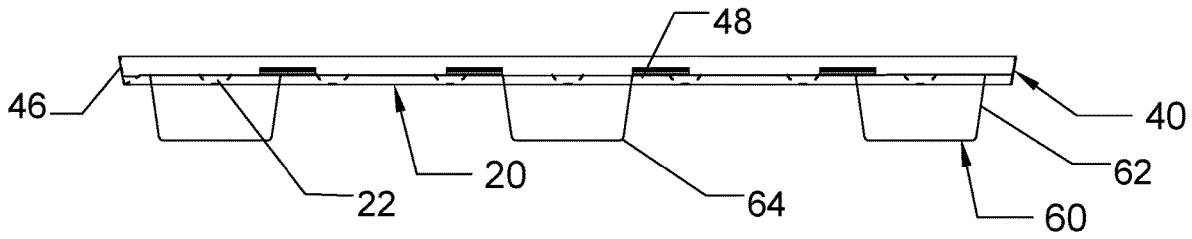
FIG. 6 shows a left side view of the present invention 10.
Figure 7:
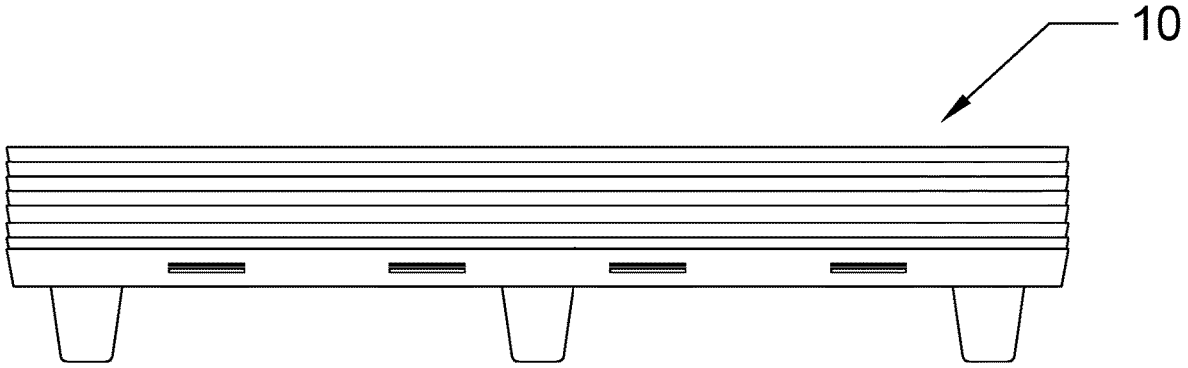
FIG. 7 illustrates a front view of a plurality of nestable steel pallets 10 nested.

The nesting assembly 60 may include stacking elements 62. The stacking elements 62 may have a bottom 64 and an opening 62*a*. The stacking elements 62 are made through the metal stamping process. The stacking elements 62 may vertically depress with respect to the stiffening ribs 22. The stacking elements 62 may extend downwards of the stiffening ribs 22 and the pallet frame 44 defining a tapered shape as best shown in FIG. 5. It also may be suitable for the stacking elements 62 to have a rectangular shape, a triangular shape, or any other suitable shape. The stacking elements 62 may be equidistantly located on the edges and the middle of the pallet frame 44 and the stiffening ribs 22. It also may be suitable for the stacking elements 62 to have any other configuration. The stacking elements 62 may be made of ultra-high strength steel. It should be understood that it also may be suitable for the stacking elements 62 to be made of aluminum, copper, mild steel, or any other suitable material that can be modified through the metal stamping process. The stacking elements 62 may be hollow. The bottom 64 of the stacking elements 62 may be planar. The bottom 64 of the stacking elements 62 may have a rectangular shape, a triangular shape, or any other suitable shape. Nestable steel pallets 10 may be nested by introducing the stacking elements 62 of a nestable steel pallet 10 into the stacking elements of an additional steel nestable pallet 10 through the openings 62*a*. A plurality of nestable steel pallets 10 may be nested by coupling their stacking elements one above the others.

Figure 2:
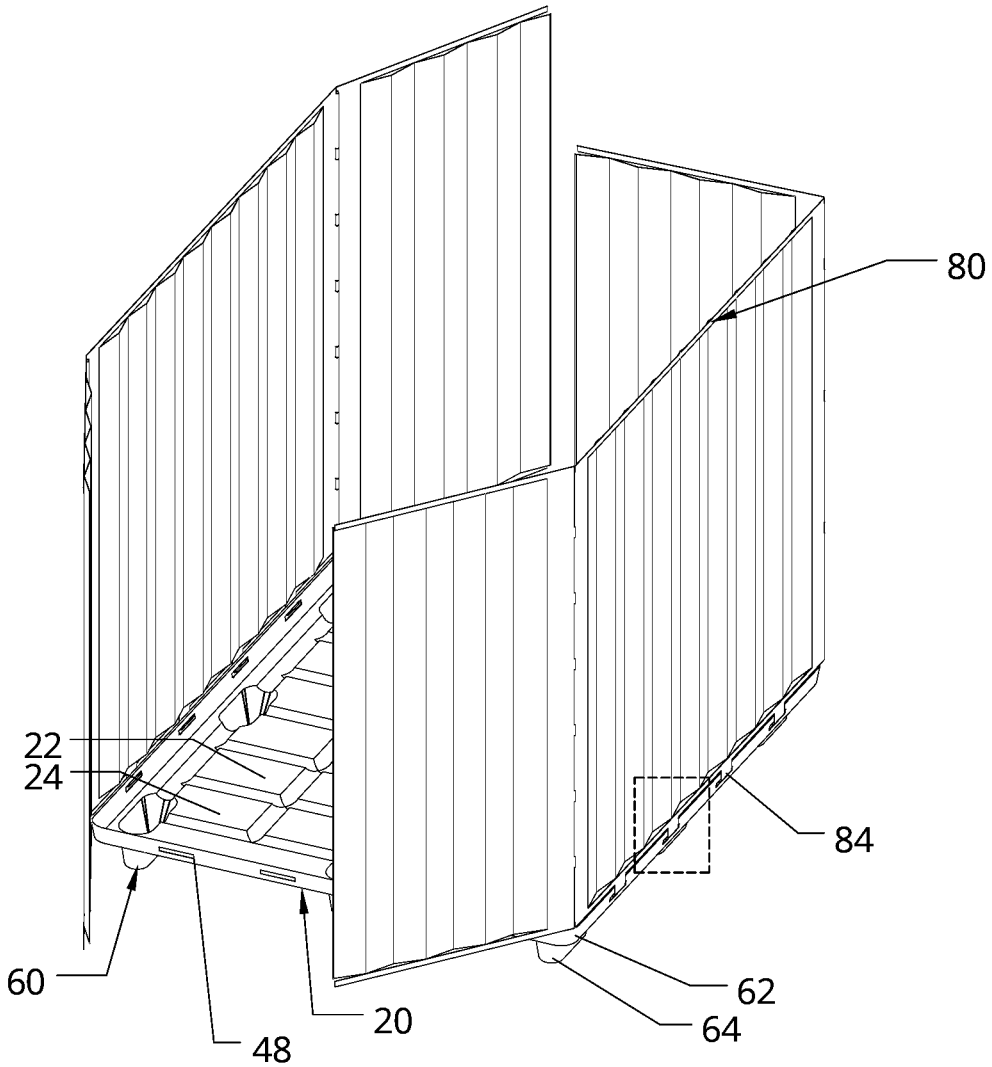
FIG. 2 shows an isometric operational view of the present invention 10 having side panels 82 attached to the hook attachments 48.
Figure 2A:
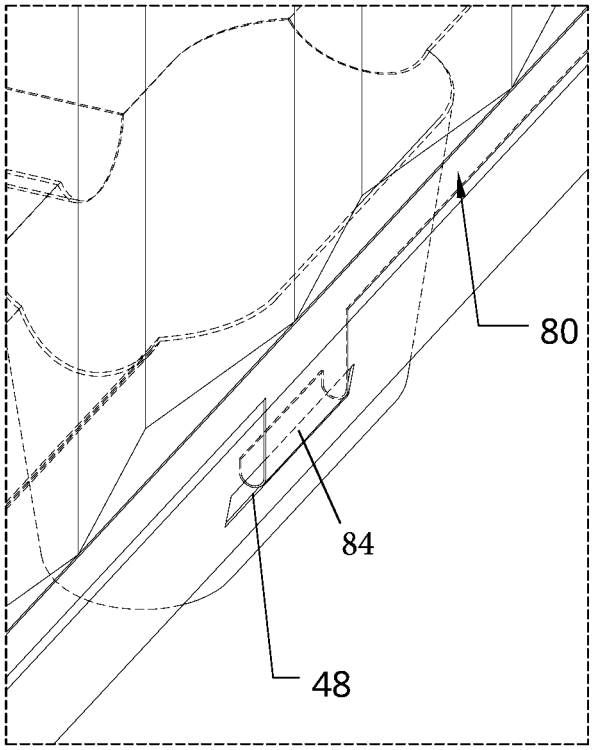
FIG. 2A is a sectional see-through view of the hooks 84 inserted in the hook attachments 48.
Figure 3:
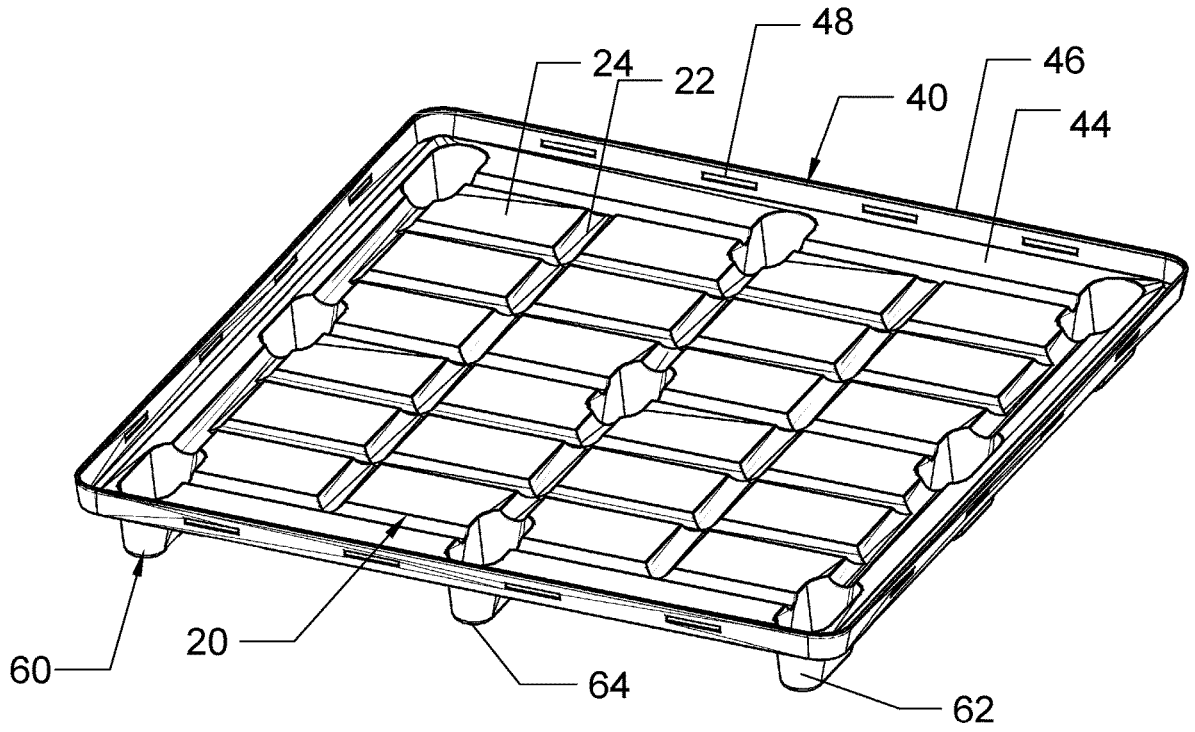
FIG. 3 illustrates an isometric view of the present invention 10. The present invention includes a pallet assembly 20, a support assembly 40 and a nesting assembly 60.
Figure 4:
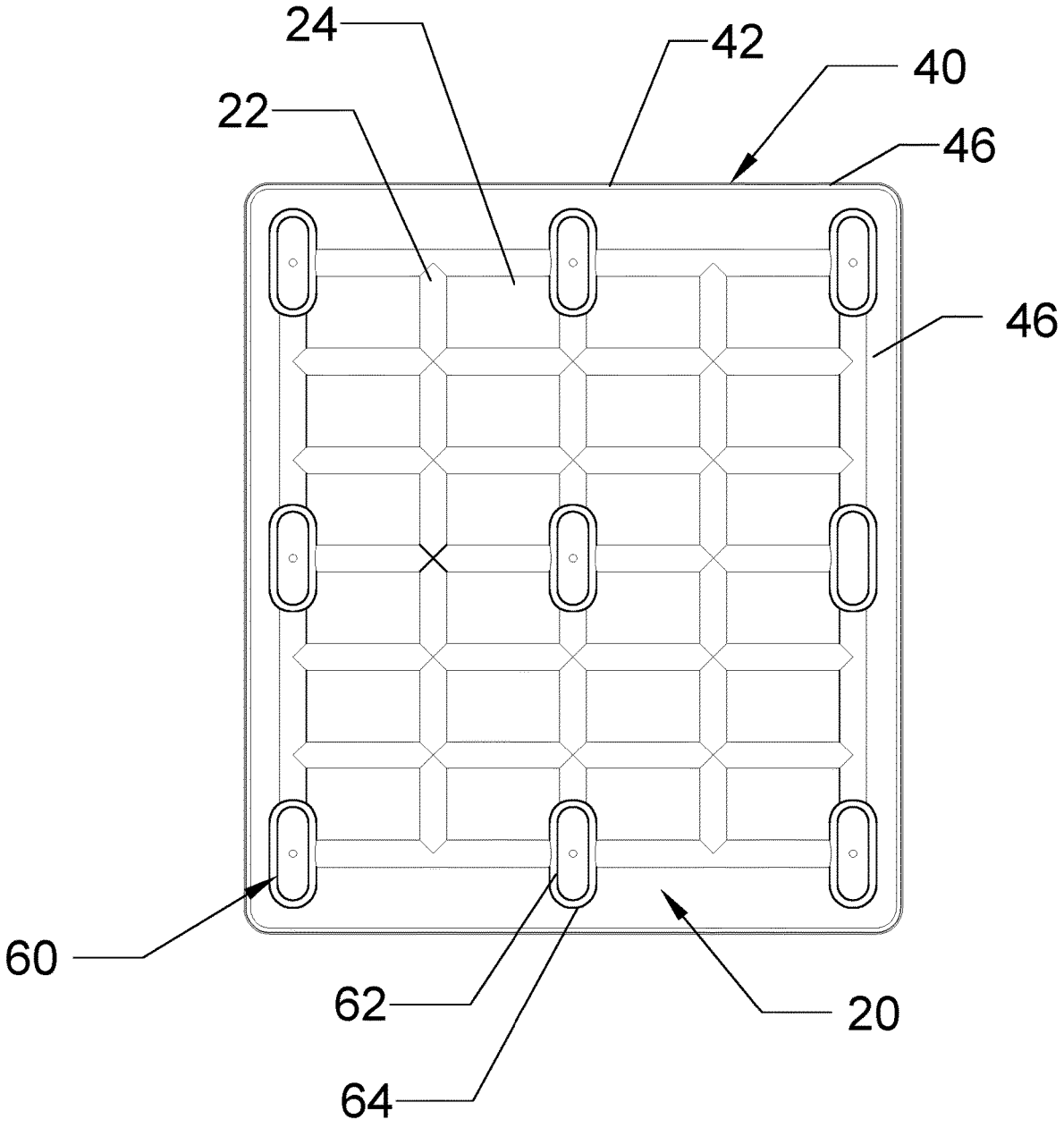
FIG. 4 is a representation of a bottom view of the present invention 10.

In a preferred embodiment the bottom 64 of. The bottom 64 of the stacking elements 62 is placed over a planar surface and a good may be placed over the nestable steel pallet 10. When cargo 102 is not placed over the nestable steel pallet 10, the nestable steel pallet 10 may be nested with additional nestable steel pallets for storage purpose. The walls of the stacking element 62 may have a predetermined thickness. In a preferred embodiment the thickness of the stacking element 62 is of 0.020 to 0.032 inches. Due to the thickness of the present invention 10 and the use of the stacking elements 62, only a little space is needed for storing the nestable steel pallets 10 as best illustrated in FIG. 2.

The nestable steel pallet 10 may be adapted to include a side panel assembly 80. The side panel assembly 80 may include side panels 82 and hooks 84. The side panels 82 may have a rectangular shape. The side panels 82 may be defined in a grid configuration or by a plurality of stiffening ribs vertically aligned. In a preferred embodiment the side panels 82 may be made of ultra-high strength steel. It also may be suitable for the side panels 82 to be made of aluminum, copper, mild steel, or any other suitable material that can be modified through the metal stamping process. The side panels 82 may have a predetermined thickness. In a preferred embodiment the thickness of the side panels 82 is of 0.020 to 0.032 inches. The side panels 82 may be perpendicularly attached to the nestable steel pallet 10 through the hooks 84. The hooks 84 may be inserted in the hook attachments 48 to fix the side panels 82 to the load retainers 46.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A nestable steel pallet, consisting of:

a pallet assembly, wherein said pallet assembly includes a layer, said layer has a predetermined thickness, said layer includes stiffening ribs delimited by a pallet frame, said stiffening ribs are vertical stiffening ribs and horizontal stiffening ribs, said vertical stiffening ribs are at least five vertical stiffening ribs, said horizontal stiffening ribs are at least five horizontal stiffening ribs, wherein said vertical stiffening ribs are vertically and equidistantly disposed one to the other in said layer, wherein said horizontal stiffening ribs are horizontally and equidistantly disposed defining rectangular surfaces of layer therebetween, said rectangular surfaces having a same length and width therebetween, said rectangular surfaces are planar, said vertical stiffening ribs are perpendicular to said horizontal stiffening ribs defining a rectangular grid configuration, wherein said pallet frame slants up from said grid configuration of said stiffening ribs, said stiffening ribs have a semi cylindrical shape;

a support assembly, wherein said support assembly includes a load retainer, said load retainer extends perpendicularly upwards from the edges of said pallet frame, wherein said load retainer is configured to prevent cargo from shifting over said edges of said layer, said load retainer has at least two hook attachments in each side of said load retainer, said at least two hook attachments are openings that transversely go through said each side of said load retainer;

a nesting assembly, wherein said nesting assembly includes stacking elements, said stacking elements are hollow, said stacking elements are equidistantly located beneath said layer, said stacking elements extend downwards from said layer, said stacking elements are adapted to be inserted into additional stacking elements to nest a plurality of said pallets, said layer rests on said stacking elements, said stacking elements, said load retainer, said layer and said side panels are formed through the metal stamping process, said nestable steel pallet is capable of support the weight of cargo, said nestable steel pallet is made of steel, said pallet has a thickness of 0.02 to 0.032 inches, said pallet is formed by means of the metal stamping process; and a side panel assembly, wherein said side panel assembly includes side panels, said side panels are adapted to be perpendicularly attached to said nestable steel pallet, said side panels have at least two hooks, said at least two hooks are configured to be inserted into said at least two hook attachments, wherein said hooks protrude downwardly from a bottommost end of said side panels, wherein said side panels have triangular indentations vertically extending therein.

* * * * *